US011141882B2

(12) United States Patent
Bhat

(10) Patent No.: US 11,141,882 B2
(45) Date of Patent: Oct. 12, 2021

(54) CONCRETE BATCHING PLANT HAVING REDUCED CYCLE TIME AND REDUCED INSTALLATION AND DISMANTLING TIME

(71) Applicant: Adde Jagadish Bhat, Karnataka (IN)

(72) Inventor: Adde Jagadish Bhat, Karnataka (IN)

( * ) Notice: Subject to any disclaimer, the term of this patent is extended or adjusted under 35 U.S.C. 154(b) by 440 days.

(21) Appl. No.: 16/078,445

(22) PCT Filed: Nov. 25, 2016

(86) PCT No.: PCT/IN2016/050420

§ 371 (c)(1),
(2) Date: Aug. 21, 2018

(87) PCT Pub. No.: WO2018/065991

PCT Pub. Date: Apr. 12, 2018

(65) Prior Publication Data

US 2019/0054657 A1 Feb. 21, 2019

(30) Foreign Application Priority Data

Oct. 7, 2016 (IN) ..... 201641034550

(51) Int. Cl.

| | |
|---|---|
| ***B28C 7/04*** | (2006.01) |
| ***B28C 7/06*** | (2006.01) |
| ***B28C 7/12*** | (2006.01) |
| ***B28C 7/10*** | (2006.01) |
| ***B28C 9/00*** | (2006.01) |

(52) U.S. Cl.

CPC ..... *B28C 7/0481* (2013.01); *B28C 7/0427* (2013.01); *B28C 7/062* (2013.01); *B28C 7/067* (2013.01); *B28C 7/068* (2013.01); *B28C 7/10* (2013.01); *B28C 7/124* (2013.01); *B28C 7/128* (2013.01); *B28C 9/00* (2013.01)

(58) Field of Classification Search

CPC ..... B28C 7/0481

USPC ..... 366/18, 20, 26, 34, 35

See application file for complete search history.

(56) References Cited

U.S. PATENT DOCUMENTS 808,599 A * 12/1905 Crichfield ..... B28C 9/00 366/18
2,374,732 A * 5/1945 Colburn ..... E01C 19/1022 264/31
3,804,463 A 4/1974 Mordhusrt

FOREIGN PATENT DOCUMENTS

GB 832774 4/1960
GB 924064 4/1963

OTHER PUBLICATIONS

European Patent Office; International Search Report; dated Jun. 12, 2017.

* cited by examiner

*Primary Examiner* — David L Sorkin
(74) *Attorney, Agent, or Firm* — Price Heneveld LLP

(57) ABSTRACT

A method of operating a concrete batching plant includes loading aggregates into an aggregate storage bin divided into compartments from the ground level by wheel loader, discharging the material from storage bin through batching gates fitted into a weighing hopper, hydraulically lifting the aggregates after being weighed in the weighing hopper, conveying cement through a screw conveyor into a cement weigher and discharging the same into a mixer, mixing and compacting the aggregates for a pre-determined time, discharging the mixed and compacted concrete into a concrete carrying hopper, transporting the concrete carrying hopper to a desired height, and loading the concrete into mobile transit mixer or concrete pump, based on the site requirement.

9 Claims, 11 Drawing Sheets

CONCRETE BATCHING PLANT HAVING REDUCED CYCLE TIME AND REDUCED INSTALLATION AND DISMANTLING TIME

FIELD OF THE INVENTION

The present invention relates in general to batching plants for concrete making and in particular to a concrete batching plant with having reduced cycle time and reduced installation and dismantling time. It is a high performance concrete batching plant having a high performance process to reduce the cycle time of the plant which helps in achieving higher plant capacity in terms of concrete production with lower batch sizes. It optimizes the overall plant system that encompasses the size and land footprint of the zone dedicated to the stationary batching plant as well as the storing, the feeding and the weighting of the various ingredients, which are aggregates of various type, sands, cement material, admixtures and water.

BACKGROUND AND PRIOR ART

Concrete batching plant is used to produce concrete by mixing Sand, aggregates (stones of different sizes), cement, water and other special materials like Polypropylene fibres, steel fibres, micro silica and admixtures like chemicals for delaying setting time of cement.

After adding all material together in predetermined proportion based on the design mix recipe, these materials are mixed in a motorised concrete mixer for a prefixed time in order to achieve homogeneous material.

In the past, concrete batching plants were categorised to two broad classes. One is the permanent/static type high capacity plant where the various parts were hauled to the plant site and erected piece by piece on a suitable framework of structural steel. This type of batching plant has the advantage of large size, convenient storage of materials near the batching plant and large capacity or throughput rate. Their disadvantages include high expenses of construction, assembling the plant from its basic components at the construction site. The permanence of such plants can also be viewed as a disadvantage, since the dismantling of a plant involves processes in reverse order of substantially all the constructional steps, consuming substantial time and the re-erection of the plant at another site involves the same processes as done during its original construction.

The other type of concrete batching plant is the portable plant which consist generally of frameworks carrying batchers, conveyors, scales, control equipment and small silos, in which frameworks are equipped with wheels so they may be towed by tractor or are otherwise adapted to be transported from site to site. Their disadvantage includes a relatively small through-put capacity and lack of ample material storage capacity at the batching point. The latter disadvantage increases operating costs by necessitating additional labour for frequent refilling of the relatively small materials silos inherent in such portable plants.

Process of Preparing Concrete:

The following steps are involved during the production of concrete in a batching plant:

Step I: Aggregate (stones and sand) storage bins are filled with aggregates by wheel loader over a long Ramp to the height of bins or by means of a Belt Conveyor.

Step II: Different sizes of aggregates are stored in different bins of varying capacities.

Step III: Aggregate bins are fitted with batching gates at the bottom through which material is discharged into the weighing skip bucket or weighing conveyor.

Step IV—Different materials or batched in an automatic weighing hopper or conveyor or weigh feeder by feeding them from bins to weigher by gravity.

Quantity to be batched is predetermined based on the recipe for individual aggregates, design mix and the batch size.

There are two types batching of ingredients i.e. sand, stones, cement, water and chemicals.

1. Manual batching—Manual batching of ingredients are done at small concreting needs at small construction sites and is a primitive method of concrete making in small mixer called one bag mixer. This is more of a volumetric batching and does not qualify in the approved norms of gravimetric electronic concrete batching plant.
2. Automatic batching—in this process different aggregates are stored at a height in silos, bins or on ground with an elevated heap of materials.

Step V—Cement is conveyed from the silos to a Cement weigher through screw conveyors of length over 12 mtr length and with inclination of over 45° depending on the capacity of the plant.

Step VI—Weighed cement is discharged into mixer by gravity.

Step VII—The batched ingredients are conveyed from the weighing conveyor to the mixer by an additional long conveyor of length over 40 Mtr, or by skip weighing bucket with an inclination over 60°

Step VIII: Aggregates, cement, water and chemicals are mixed in the mixer for a pre-determined time.

Step IX—In all conventional plants mixer is located at around 5 meters above the ground and production of concrete and discharging into a Transit mixer mounted on a truck chassis takes place from that high altitude.

Disadvantages of the prior art:

1. Increased installation and dismantling time for the plant since the ground hopper, bin feeding conveyor, mixer, cement and water weigher, railings, skip track and supports, cones are required to be installed and/or dismantled and transported separately.
2. Additional requirement of rubber belt conveyor, gear box and electrical motor, roller with bearing mechanism and heavy structure for carrying weighed aggregates to the skip. This increases installation and subsequent maintenance cost on account of large number of moving parts resulting in high life time cost of the plant.
3. Increased overall operational cost for preparing the ramp for the loader to load material into ground hopper or to aggregate storage bins, diesel consumption and tyre wear of loader due to inclination of ramp, maintenance of the vehicle is high due the stock piles are present at a long distance.
4. Increased downtime as large number of equipments/parts is required to set up the plant.
5. Separate concrete precast slabs are required as foundation for setup such as a bulky plant.
6. More space is required for plant as well as during plant installation.
7. Huge ramps, loaders or special belt conveyors required for loading the aggregates in to the aggregate bins which increases the overall plant cost.

8. Heavy tall steel structural fabrication is required for mounting the mixer, bins and cement silos which also increase the cost of the plant.
9. Tools and tackles required for erection of the plant is high.
10. Overall power requirement of the plant is very high.
11. Life risk is very high due to skip fall, belt snapping etc.
12. High cycle time due to use of ramp, long conveyor, skip etc. which decreases the total through put of the plant.
13. Increase in number of wear and tear parts.
14. Increase in downtime due to frequent breakdowns.
15. Loss of aggregates due to spillage while transferring from rubber belt to skip.

Thus, there is a great need in the industry for a concrete batching plant with reduced structures, suitable for easy installation and handling, capable of producing concrete with enhanced operational safety and in an efficient and economic way. The present invention seeks to overcome not only the above, but also other drawbacks of the prior art. This will become clear from the description of the invention that follows.

SUMMARY

The primary object of the invention is to provide a concrete batching plant which is easy to install due to its reduced structure.

Another object of the invention is to provide a concrete batching plant which is capable of reducing the maintenance cost as well as the downtime of the plant.

A further object of the invention is to provide a concrete batching plant which reduces installation and dismantling time of the plant.

Yet another object of the invention is to provide a concrete batching plant which prevents accident at the plant due to skip fall, belt snapping etc.

Another object of the invention is to provide a concrete batching plant which is capable of reducing the overall spaces required for plant installation.

Yet another object of the invention is to provide a concrete batching plant which is capable of reducing the foundation cost of the plant.

Another object of the invention is to reduce the loading height of the aggregate bins and hence reduce the ramp construction cost.

Another object of the invention is to reduce the overall power consumption to run the plant.

One more object of the present invention is to reduce the cycle time of plant to a great extent which helps in achieving higher plant capacity with lower batch sizes.

Yet another object of the invention is to eliminate the use of skip rope lift assembly or weighing conveyor and inclined conveyor which contribute to major part of the plant cost.

Further one object of the present invention is to reduce the initial cost by eliminating bulky steel fabricated structures.

Another object of the invention is to reduce the maintenance cost of the plant due to huge reduction in moving parts.

Yet another object of the invention is to eliminate weighing conveyor in case of higher capacity concrete plants.

Another object of the invention is to lift finished product to the height of loading to transit mixer instead of lifting the aggregates and mixing at a height.

Another object of the invention is to increase the rate of concrete discharge from the mixer to concrete hopper by having two openings or bigger openings.

How the foregoing objects are achieved will be clear from the following description. In this context it is clarified that the description provided is non-limiting and is only by way of explanation.

A method of operating a concrete batching plant comprises of the steps of:

- loading aggregates comprising of sand and stones of different sizes into each compartment of the aggregate storage bin from the ground level by wheel loader;
- discharging the material from storage bin by gravity through batching gates fitted at their bottom into a weighing hopper;
- lifting the aggregates after being weighed in weighing hopper from 2 mtr to 3 mtr-3.5 mtr. above the ground level hydraulically or weighed aggregates lifted pneumatically;
- Simultaneously conveying cement through screw conveyor into a cement weigher and discharging the same into mixer;
- Water is discharged into the mixer either by gravity or by pump/pressure nozzle.
- mixing and compacting of the aggregates, which are cement, water and chemicals, for a pre-determined time;
- discharging the mixed and compacted concrete into a concrete carrying hopper;
- transporting the concrete carrying hopper with the concrete to desired height either through hydraulically (16), rack and pinion or rope arrangement; and
- loading the concrete into mobile transit mixer or concrete pump, based on the site requirement.

A concrete batching plant with reduced cycle time for executing the method as described above comprises of a aggregate storage bin, divided into several compartments for each aggregate, supported on a base structure, for discharging the required amount of aggregates into a weighing hopper. The weighing hopper is mounted on load cell placed below the aggregate storage bin loaded by the aggregates from the storage bin by gravity through batching gates. The aggregate bin is set at a height close to the ground level. A wheel loader is provided for loading the aggregates directly into said bin. A hydraulically controlled weighing hopper with an inclination of angle A° is provided for lifting and discharging the aggregates into a mixer by means of gates. The gates are placed below the weighing hopper. Horizontal type cement silos are provided for supplying cement to the mixer. A short screw conveyor with a small inclination is used for dosing of cement. Weighers are provided for weighing cement and water before supplying to the mixer and a concrete carrying hopper travelling on a rail hydraulically is provided for discharging its contents into a truck loaded transit mixer through gates.

The batching gates are opened and closed by pneumatic cylinders and the weighing hopper is adapted to weigh the aggregate as per requirement, thereby eliminating need for a weighing conveyor irrespective of the size and type of the plant. The weighing hopper is lifted hydraulically or the weighed aggregate is lifted pneumatically.

The mixer is mounted almost at the ground level on a simple column structure. The concrete hopper is lifted up hydraulically, alternatively through a rope and pulley system to reach the desired height.

The horizontal type cement silos have a discharge height between 2.5 and 3.5 mtr and a charging height between 7 and 8 mtrs. The cement weigher is mounted just above the mixer with an inlet height of approximately 3.5 mtr (±1 mtr).

The water weigher is mounted just above the mixer at a height of around 3.5 mtrs and is adapted to discharge water into the mixer either by gravity or by pump/pressure nozzle.

BRIEF DESCRIPTION OF THE ACCOMPANYING DRAWINGS

The nature and scope of the present invention will be better understood from the accompanying drawings, which are by way of illustration of a preferred embodiment and not by way of any sort of limitation. In the accompanying drawings:—

DETAILED DESCRIPTION OF THE INVENTION

Figure 1A:
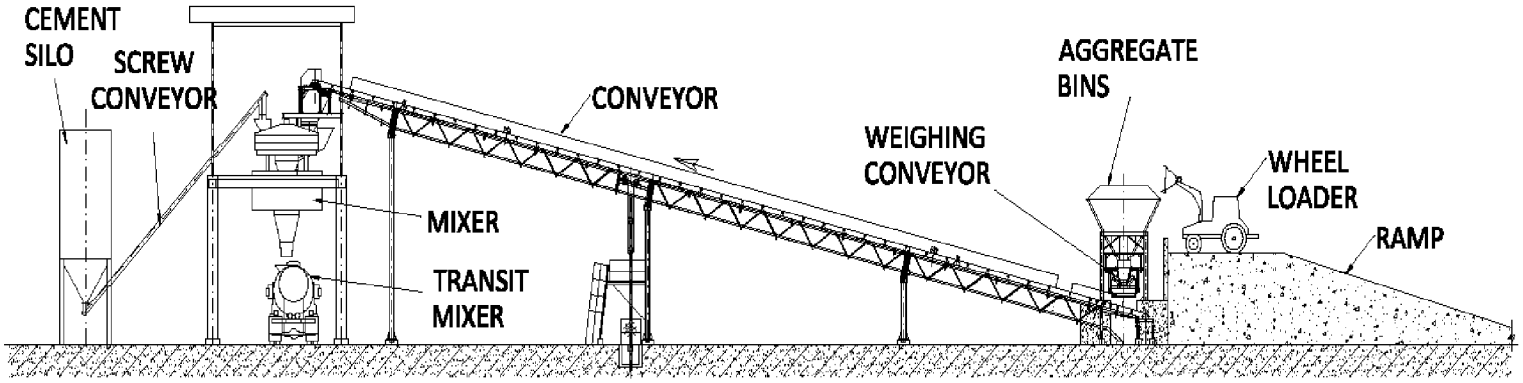
FIG - 1A (PRIOR ART)
FIG. 1A shows the elevation view of a concrete batching plant of the prior art.

Having described the main features of the invention above, a more detailed and non-limiting description of a preferred embodiment will be given in the following paragraphs with reference to the accompanying drawings.

In all the figures, like reference numerals represent like features. Further, the shape, size and number of the devices shown are by way of example only and it is within the scope of the present invention to change their shape, size and number without departing from the basic principle of the invention.

Further, when in the following it is referred to "top", "bottom", "upward", "downward", "above" or "below", "right hand side", "left hand side" and similar terms, this is strictly referring to an orientation with reference to the apparatus, where the base of the apparatus is horizontal and is at the bottom portion of the figures. The number of components shown is exemplary and not restrictive and it is within the scope of the invention to vary the shape and size of the apparatus as well as the number of its components, without departing from the principle of the present invention.

All through the specification including the claims, the technical terms and abbreviations are to be interpreted in the broadest sense of the respective terms, and include all similar items in the field known by other terms, as may be clear to persons skilled in art. Restriction or limitation if any referred to in the specification, is solely by way of example and understanding the present invention.

The present invention provides a concrete batching plant for weight batching and mixing of cement with various aggregates, water and chemicals to make concrete. The concrete batching plant of the present invention has reduced structure which makes it easy to install, requires less space for setting up the plant and is fast in dismantling and re-built the plant.

As stated earlier, the improved concrete batching plant according to the present invention has been provided with several new and inventive features. A non-limiting list of these features is as under:

1. Aggregates are loaded directly into the aggregate storage bin, divided into several compartments for each aggregates, using wheel loader from the ground level. Thereby eliminating ramp for loading material to aggregate storage bin or to ground hopper. Also eliminating conveyor requirements for transferring aggregate from ground hopper to aggregate storage bin.
2. Batching of aggregates is done in the weighing hopper mounted on load cell placed below the aggregate storage bin.
3. Weighing conveyor is eliminated irrespective of the size and type of the plant.
4. Weighed aggregates in the weighing hopper are lifted from 2 mtrs to 3 mtr-3.5 mtr. above the ground hydraulically or weighed aggregates is lifted pneumatically.
5. Mixer is mounted just 1.3 mtrs above the ground level or almost at the ground level on a simple column structure.
6. Weighing hopper is lifted hydraulically up to 2 to 3 mtrs height and directly discharged material in to the mixer.
7. Cement weigher is mounted just above the mixer with inlet height average around 3.5 mtr (±1 mtr).
8. Dosing of cement is done with the help of a short screw conveyor which is only about 4.5 mtrs long and with a small inclination.
9. Cement silos are horizontal type with discharge height of around 2.5 mtr-3.5 mtr and charging height of around 7 to 8 mtrs. This can also be vertical type with a discharge height of about 2 to 3 mtrs.
10. Cement Weigher is mounted on simple beam fixed on the cement silos and has 2 discharge points for faster discharge and to improve the spread of material in the mixer.
11. Water weigher is mounted just above the mixer at a height of around 3.5 mtrs and is discharged into mixer either by gravity or by pump/pressure nozzle.
12. Concrete mixed in the mixer is discharged up to a carrying hopper and this hopper is lifted up hydraulically.
13. Concrete carrying hopper moves on a fixed rail and then discharges concrete into truck mounted transit mixer directly or through a waiting hopper.

Figure 1B:
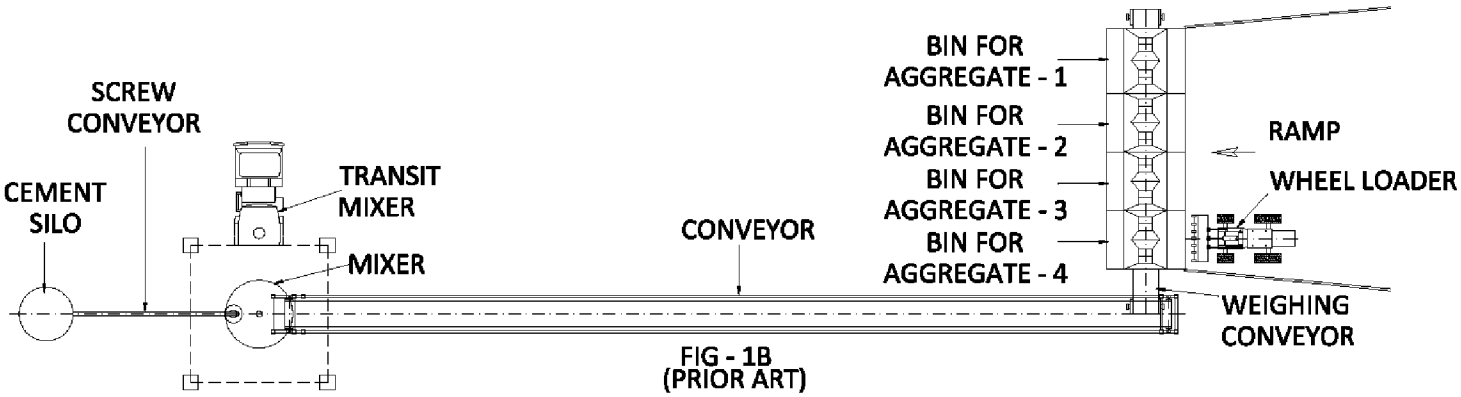
FIG - 1B (PRIOR ART)
FIG. 1B shows a plan view of a concrete batch plant of FIG. 1A.

Referring now to FIGS. 1A and 1B which shows the elevation and plan view respectively of the concrete batching plant of the prior art. With reference to FIG. 1A, the entire assembly of concrete batching plant is having heavy and a rigid structural frame for mixer and the aggregate bin. Heavy Structures are also required for the Belt Conveyor carrying weighing conveyor to the mixer. A ramp is created for the wheel loader to load the aggregates in the aggregates bins or Aggregates are loaded in to a ground hopper. A Conveyor with feed point below the ground hopper carries the aggregates over a particular distance and height and discharges into aggregate storage bins. The aggregates are released from the aggregate bins onto weighing belt conveyor through aggregates dosing cones with the help of batching gates. Batching of aggregates is done by weighing conveyor for higher capacity plants suspended on load cells or by skip bucket suspended on load cells placed below the aggregate storage bins. Weighed aggregates are lifted up to a height of around 6.5 mtr. to 7 mtr. by another inclined conveyor carrying the material from the weighing conveyor to the mixer or up to a height of around 5 mtr. by a skip rope and pulley drum arrangement. Concrete mixer is mounted on a fabricated heavy structure mounted on civil foundations or on steel mobile foundations. Steel structure housing the mixer, cement weigher and water weigher are as tall as 8 mtr. to 10 mtr and as heavy as up to 15 tons. Weighed aggregates can also be discharged into the mixer either by lifting the skip buckets up to 7 to 9 mtr height or by rotating the heavy skip bucket above the mixer at a height of around 9 mtr.

In a batching plant where conveyors are used to weigh and carry aggregates, conveyor discharges the material into a waiting hopper which is about 2 mtr above the mixer. Cement weigher is mounted above the mixer and inlet of the same is at a height ranging from 6.5 to 9.5 mtr. Dosing of cement is done with the help of screw conveyors which are around 10 to 14 mtr long depending on the capacity of the plant and is erected with inclination 45° and above. Cement silos are vertical type and are with discharge height of 2 to 3 mtr from the ground and charging height is almost at 13 mtrs to 20 mtr depending on the capacity of the silos. Cement weigher is mounted on heavy structures and is placed above the mixer with single discharge. Water weigher is mounted above the mixer at around 6.5 mtr to 9 mtr height and is discharged into mixer either by gravity or by pump/pressure nozzle. Concrete mixed in the mixer is discharged directly into the truck mounted transit mixer placed below the mixer.

Figure 3:
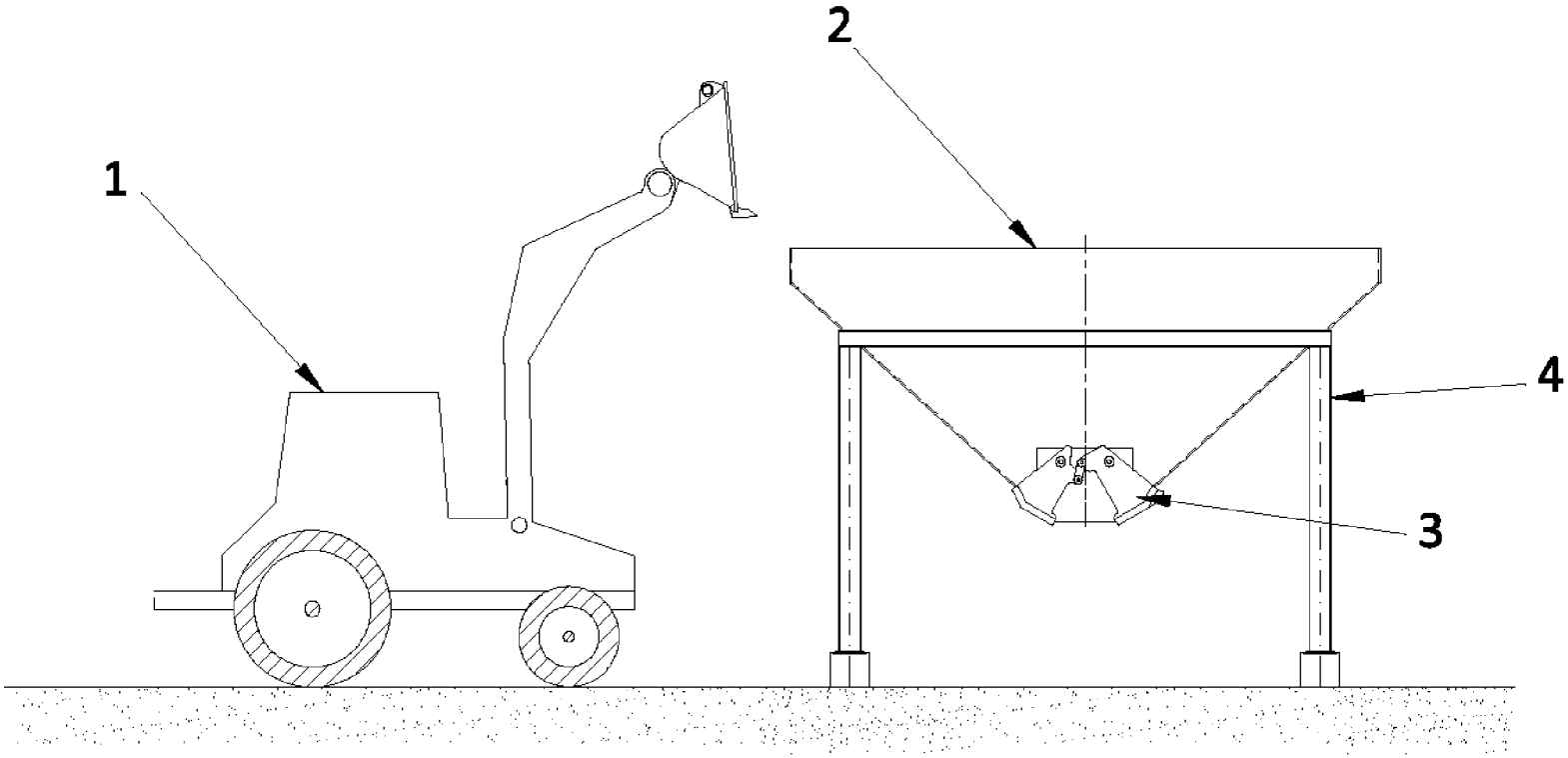
FIG. 3 is a partially profiled elevation view of the concrete mixing plant with wheel loader and aggregate bin of FIG. 2.

Referring now to FIG. 3 the concrete batching plant according to the present invention comprises of a aggregate storage bin (2), divided into several compartments for each aggregate, through which the required amount of aggregates for preparing the concrete are discharged into a weighing hopper (5) through batching gate (3). The crux of the invention lies here in that the aggregate bin (2) are set at a height close to the ground level in comparison with the conventional types, so that the aggregates can be loaded directly into the bin using the wheel loader (1) from the ground level. The aggregate bin are supported on a support base structure (4). As the storage bin (2) are close to the ground level, it is easy to dismantle as compared to the heavy fabricated structures.

A non-limiting list of advantages of the above described features is as under:

- Cost reduction due to elimination of ground hopper
- Cost reduction due to elimination of aggregate bin feeding conveyor
- Cost reduction due to elimination of ramp for the wheel loader to load material into to aggregate storage bins or to a ground hopper.
- Operation cost reduction due to elimination of conveyor motor and swiveling motor for the rotating chute.
- Operational cost reduction due to diesel consumption and tyre wear of loader due to inclination of ramp.
- Reduction in Maintenance cost as high maintenance conveyor is eliminated.
- Lower maintenance of the vehicle due to shorter lead to stock piles.
- Since the loading of aggregates into storage bin is carried out from ground level, the travel of loader reduces and smaller size of aggregate storage bin is enough to produce concrete continuously. In case, the higher capacity of the plant is required then same capacity storage bins can be used by deploying two loaders.
- Cost of aggregate storage bin is reduced to great extent as they have a simpler manufacturing process.

Figure 4:
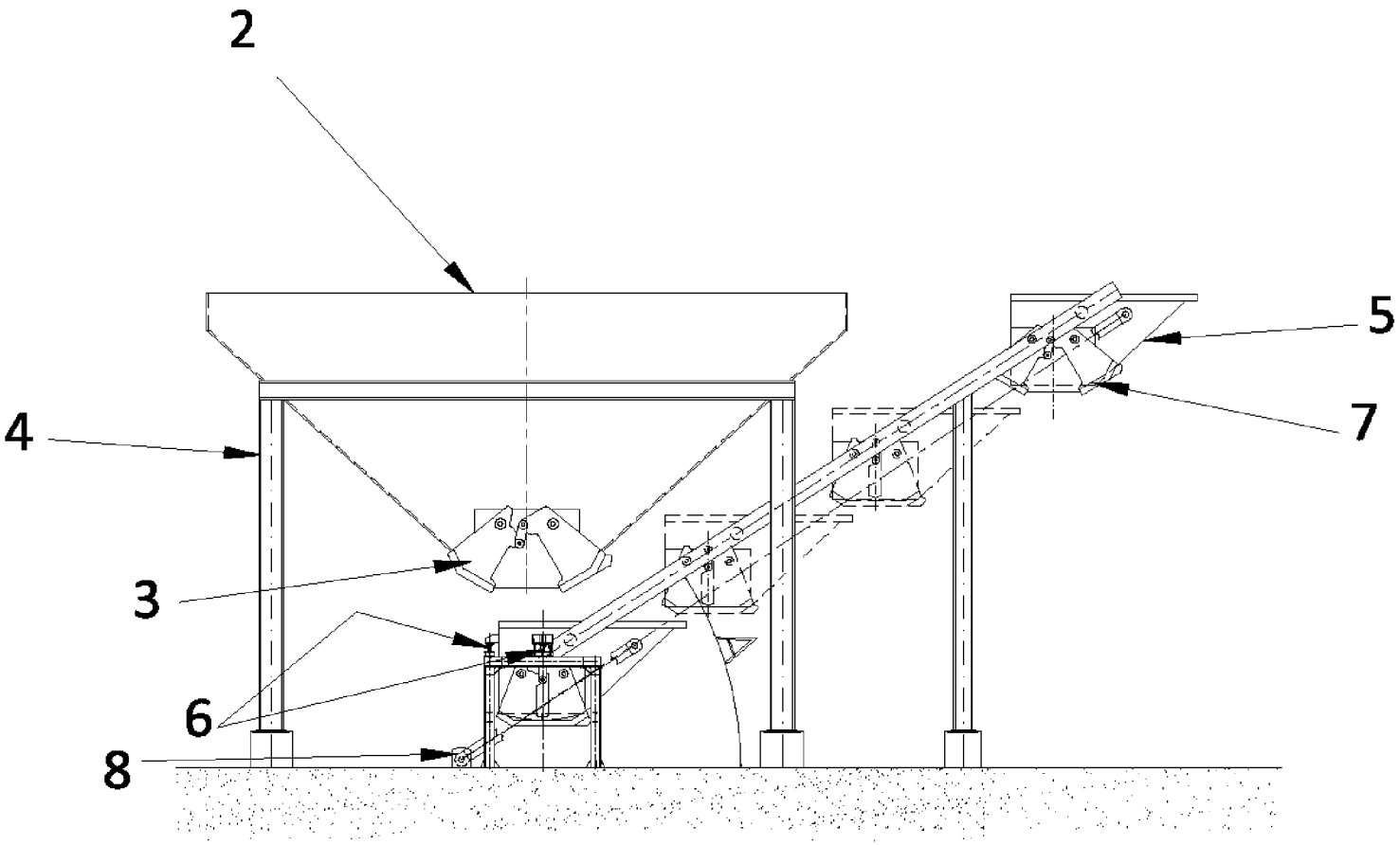
FIG. 4 is a partially profiled elevation view of the concrete mixing plant with aggregate bin and weighing hopper of FIG. 2.

Referring now to FIG. 4, aggregates are discharged from aggregate storage bin (2) through batching gates (3) by gravity into weighing hopper (5) mounted on load cell (6) placed below the aggregate storage bin (2). The opening and closing of the batching gates (3) is done with the help of pneumatic cylinders. The aggregates are weighed, as per requirement, in the weighing hopper (5) itself. The crux of the invention lies here in that the weighing conveyor is eliminated irrespective of the size and type of the plant and the weighed material is lifted from 2 mtrs to 3 mtr-3.5 mtr. above the ground hydraulically (8) with an inclination of angle A° for discharge into the mixer by the help of gate (7) placed below the weighing hopper. In another embodiment, the weighed aggregates can also be lifted pneumatically.

Advantages of the above inventive features:

- By eliminating the weighing conveyor, cost of the plant is reduced considerably.
- Operational cost reduced as the motor required for running weighing conveyor is eliminated.
- Maintenance cost reduces as the weighing conveyor maintenance gets eliminated.
- Lifting of aggregates by skip rope, pulley is eliminated and this reduces the initial cost, operational cost and maintenance cost.
- Lifting of aggregates by conveyor is eliminated which also reduces the initial cost, operational cost and maintenance cost.
- Increases safety as rope breaking, bucket falling and conveyor snapping is eliminated.

Figure 5:
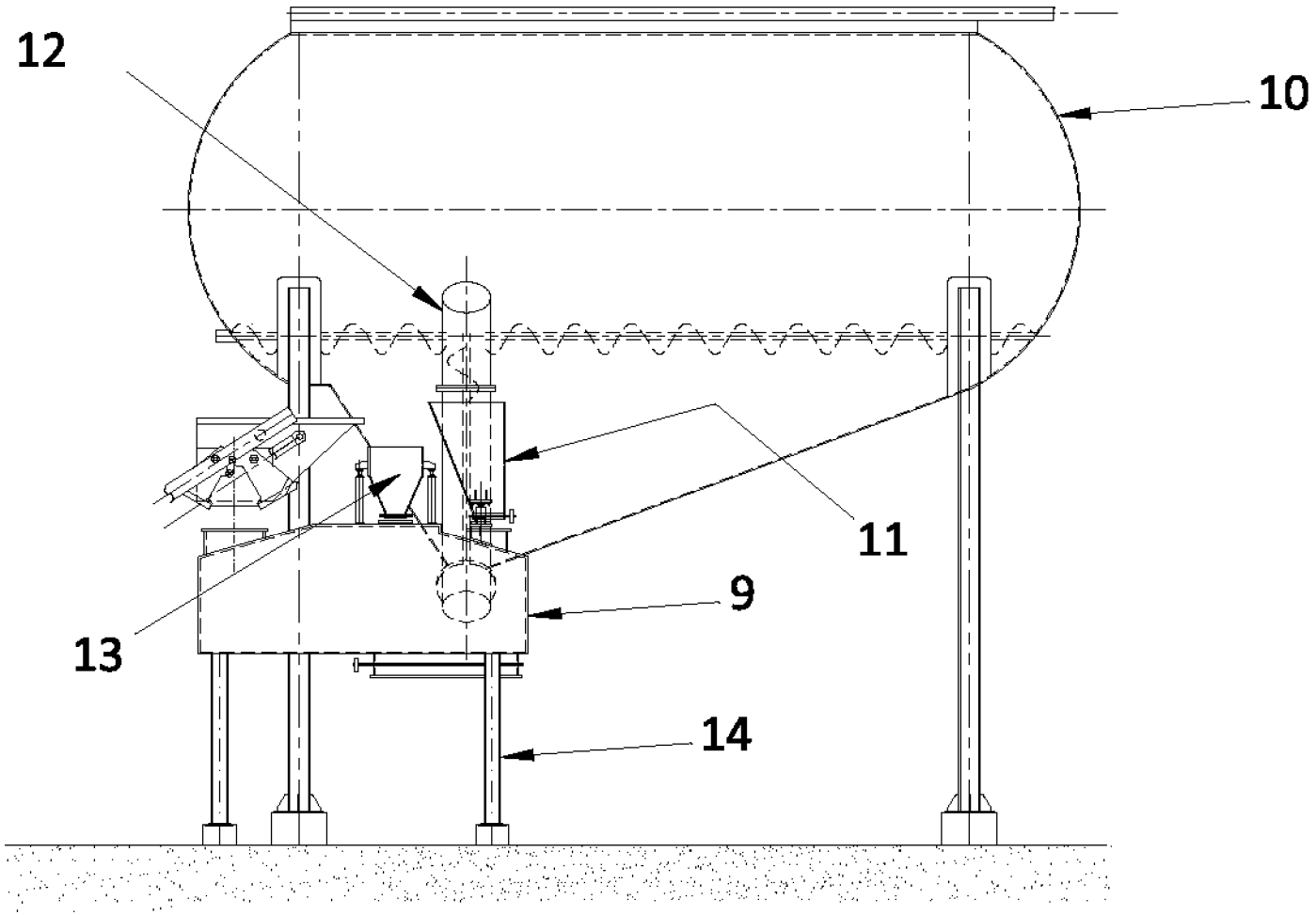
FIG. 5 is a partially profiled elevation view of the concrete mixing plant with concrete mixer, cement silo and other accessories of FIG. 2.

Referring now to FIG. 5, the material from the weighing hopper (5) is discharged to the mixer (9). The mixer (9) is mounted just 1.3 mtrs above the ground level or almost at the ground level on a simple column structure (14). The concrete mixer is capable of mixing the material, including cement, water and aggregates etc. to prepare the concrete.

Advantages of the above inventive features:

- his eliminates the heavy tall steel structural fabrication which is required for mounting the mixer.
- Cost of heavy structural steel is eliminated.
- Cost of large quantity of fabrication, surface preparation and painting is eliminated.
- This in turn reduces the manufacturing and delivery time of the plant and this result in redemption of inventory.
- Tools and tackles required for erection of the plant is reduced and also the time required for erection of the plant and dismantling of the plant is also reduced.

Cement is supplied to the mixer (9) from a cement silo (10). Cement silos are horizontal type with discharge height between 2.5 mtr to 3.5 mtr and charging height to between 7 mtr to 8 mtr. This can also be vertical type with a discharge height of about 2 mtr. to 3 mtr. Simultaneously, water is supplied to the water weigher through a water pipeline. The cement weigher (11) is mounted just above the mixer with an inlet height of approximately 3.5 mtr (±1 mtr). Dosing of cement is done with the help of a short screw conveyor (12) which is only about 4.5 mtrs long and with a small inclination. The cement and water are weighed by respective weighers (11 and 13), as per requirement, before supplying to the mixer (9).

The cement weigher (11) is mounted on a simple beam fixed on the cement silos and has two discharge points for achieving faster discharge and to improve the spread of material in the mixer. The water weigher (13) is mounted just above the mixer at a height of around 3.5 mtrs and is discharges water into the mixer either by gravity or by pump/pressure nozzle.

Advantages of the above inventive features:

Cement dosing screw is around 4.5 mts. length instead of 10 to 14 mtrs. in the conventional system. This reduces the cost of the screw conveyor.

Reduces the power consumption to almost 40% due to reduction in length and inclination of screw conveyor.

Reduces the maintenance cost and down time due to elimination of hanger bearings of screw conveyor.

Cement silos can be both vertical and horizontal type. With horizontal cement silos the height of the silo reduces and the heavy foundation cost is substantially reduced and maintenance of the silo becomes easy due to reduction of structures. Time for project completion is reduced with horizontal silo cement charging into silos consumes less power/diesel.

Figure 6:
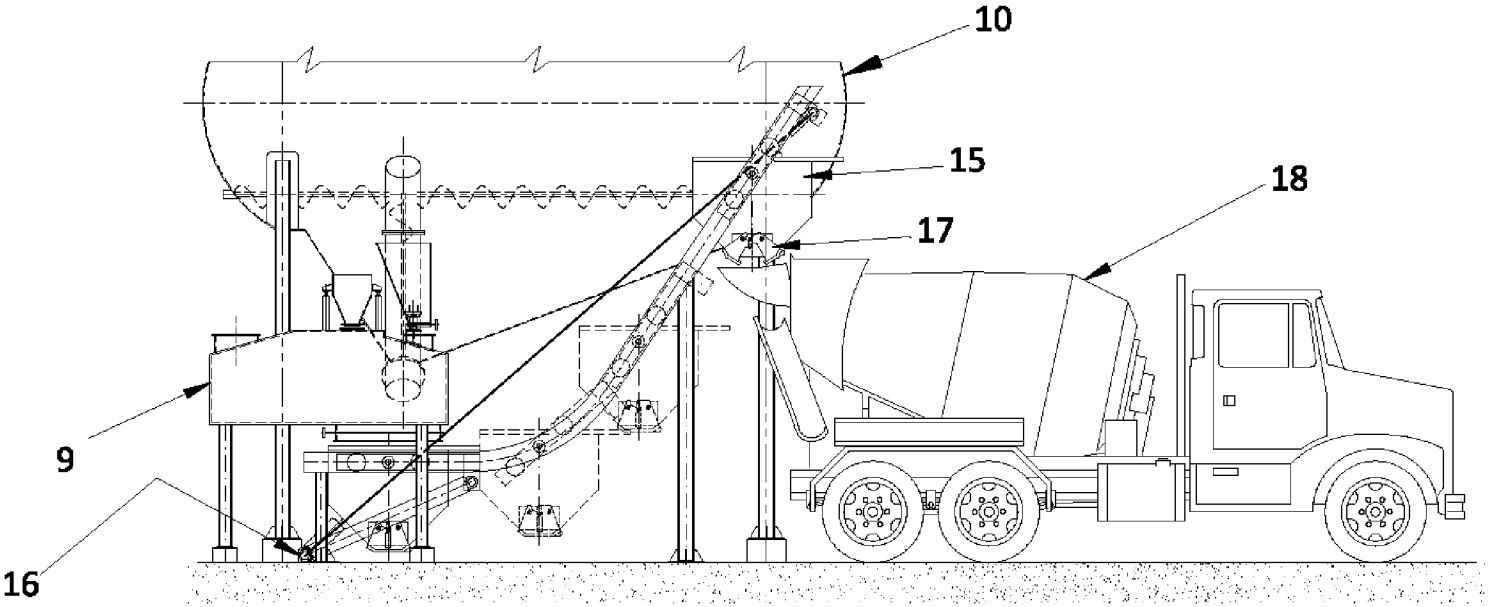
FIG. 6 is a partially profiled elevation view of the concrete mixing plant with concrete mixer, cement silo, concrete hopper and transit mixer of FIG. 2.

Referring now to FIG. 6, all ingredients are mixed in the mixer (9) and the concrete is discharged into a concrete carrying hopper (15). Hopper (15) carrying concrete travels on a rail (16) hydraulically to reach the desired height to discharge its contents into transit mixer (18) mounted on truck through gates (17).

Alternatively, hopper (15) carrying concrete is lifted up through a rope pulley system to reach the desired height to discharge into transit mixer (18) or lifted up by rack and pinion system to reach the desired height into transit mixer. It will be clear to a person skilled in the art that other types of carrying mechanism are also possible, which are all part of the present invention, as long as they allow easy lifting of the concrete hopper (15).

Advantages of the Above Inventive Feature:

Lifting the finished product i.e. concrete to the height of loading to transit mixer instead of lifting aggregates and mixing at a height which is as per the conventional way of concrete manufacturing is much more economical and saves time.

Figure 2:
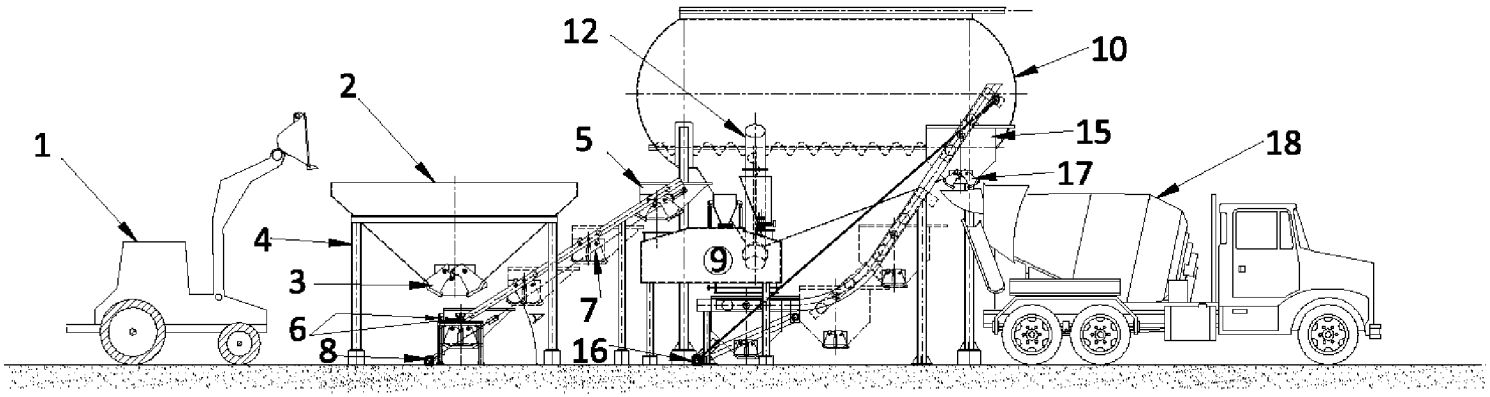
FIG. 2 shows the elevation view of a concrete batching plant as per the present design.
Figure 7:
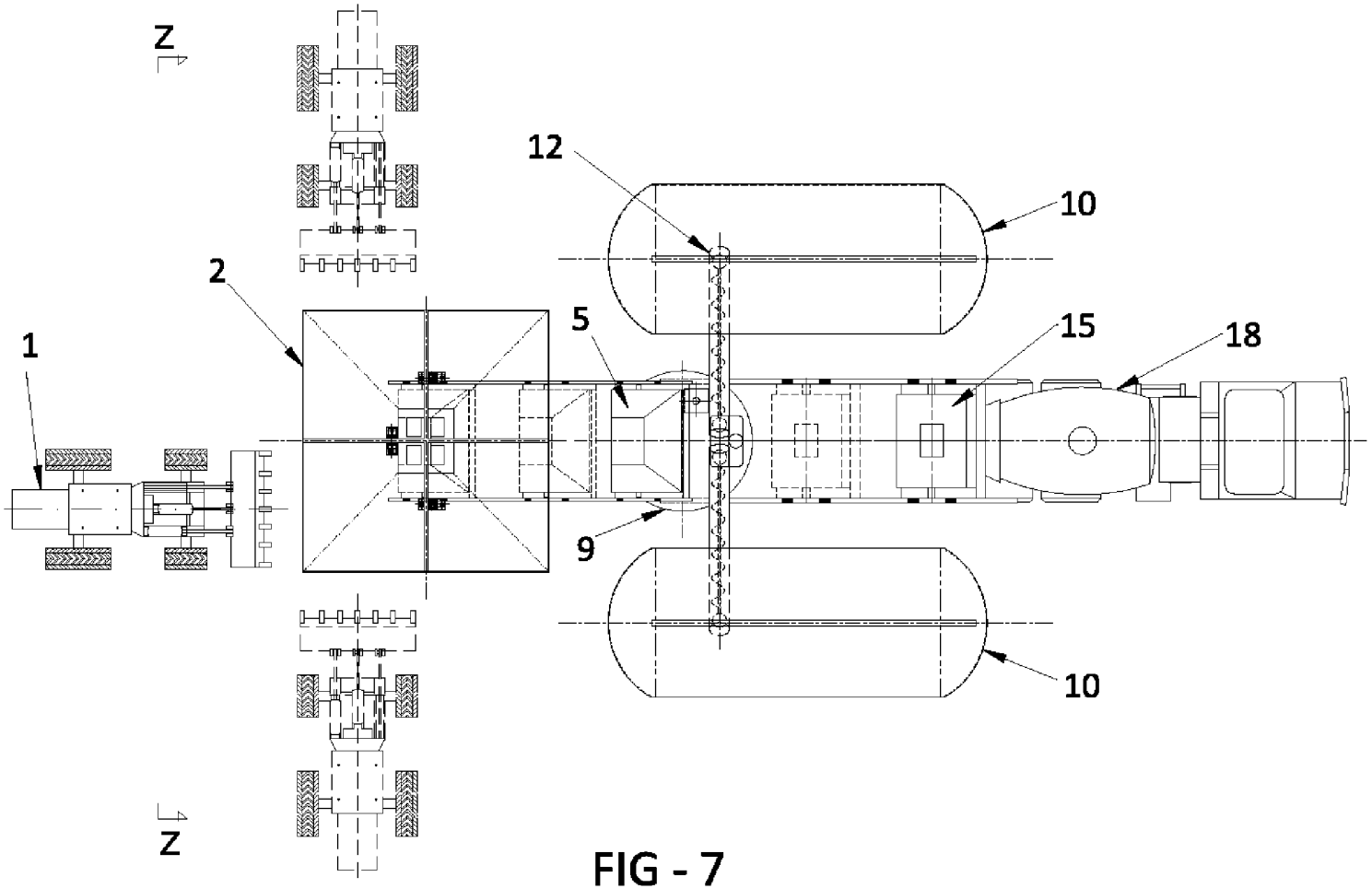
FIG. 7 is the plan view of the concrete mixing plant of FIG. 2.
Figure 8:
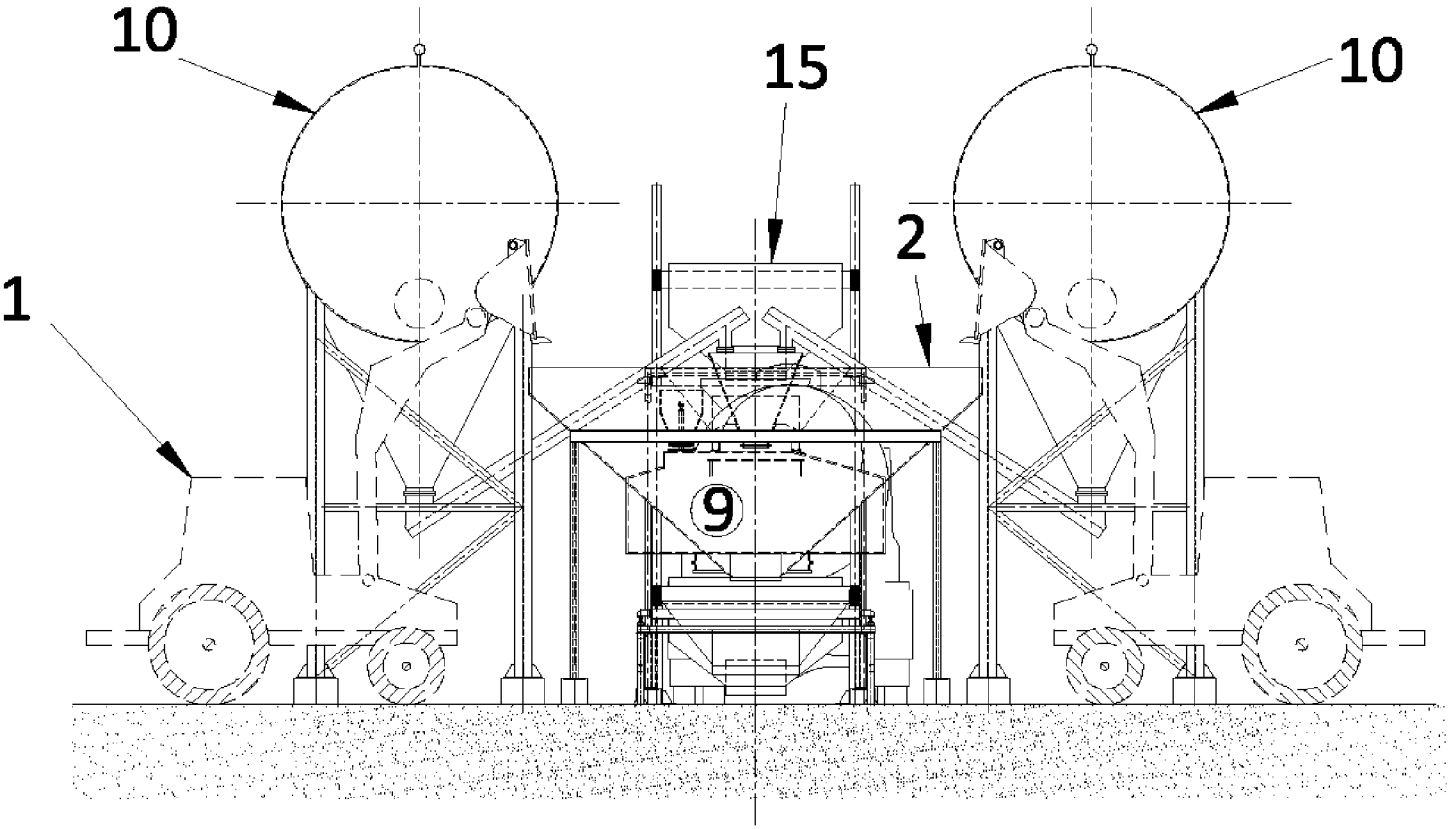
FIG. 8 is the side view of the concrete mixing plant along the line Z-Z of FIG. 7.

Method of Operating the Concrete Batching Plant According to Present Invention:

Referring now to FIGS. 2, 7 and 8, aggregates comprising sand and stones of different sizes are loaded into a aggregate storage bin (2), divided into several compartments for each aggregate, from the ground level by wheel loader (1). Different sizes of aggregates are stored in the different compartments of the same Aggregate Storage Bin. Storage bin is fitted with batching gates (3) at the bottom, as best shown in FIG. 2, through which material is discharged into the weighing hopper (5) by gravity. Aggregates which are weighed in the weighing hopper are lifted from 2 mtrs to 3 mtr-3.5 mtr above the ground level hydraulically (8) or weighed aggregates are lifted pneumatically. Cement is simultaneously conveyed through a screw conveyor (12) into a weigher and the same is discharged into the mixer (9). Aggregates, cement, water and chemicals are discharged into the mixer and are mixed for a pre-determined time.

Mixed and compacted concrete is discharged into a concrete carrying hopper (15) which transports the carrying hopper (15) with the concrete to desired height through either lifted hydraulically on rail (16), rack and pinion or rope arrangement to achieve loading of the concrete into mobile transit mixer (18) or concrete pump, based on the site requirement and condition.

INDUSTRIAL APPLICATION

Due to simplification of the processes of making the concrete the present invention have the following advantages:

Batching

Transferring of aggregates from weigher to mixer

Cement storage, dosing, discharge the rate of concrete discharge from the mixer to concrete hopper by having two openings or bigger openings and lifting the concrete hopper to desired height for loading the truck mounted transit mixer.

This will help in reducing the initial cost of the equipment to great extent.

By optimizing the sequence layout and timing of operation installed power is reduced to 60% of the conventional similar capacity plant. How the same is achieved is described in Table I.

Figure 9:
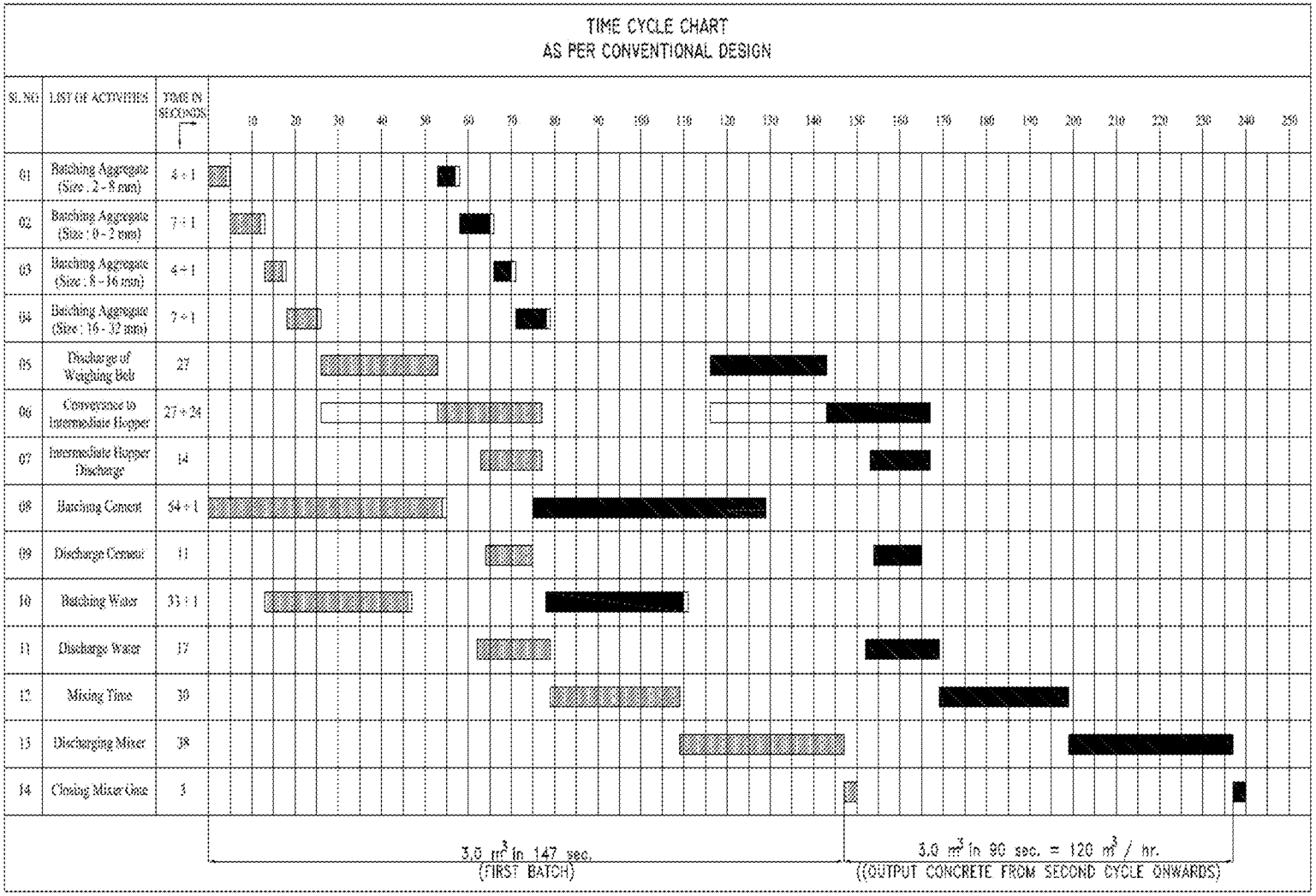
FIG. 9 is a time cycle chart as per conventional design.
Figure 10:
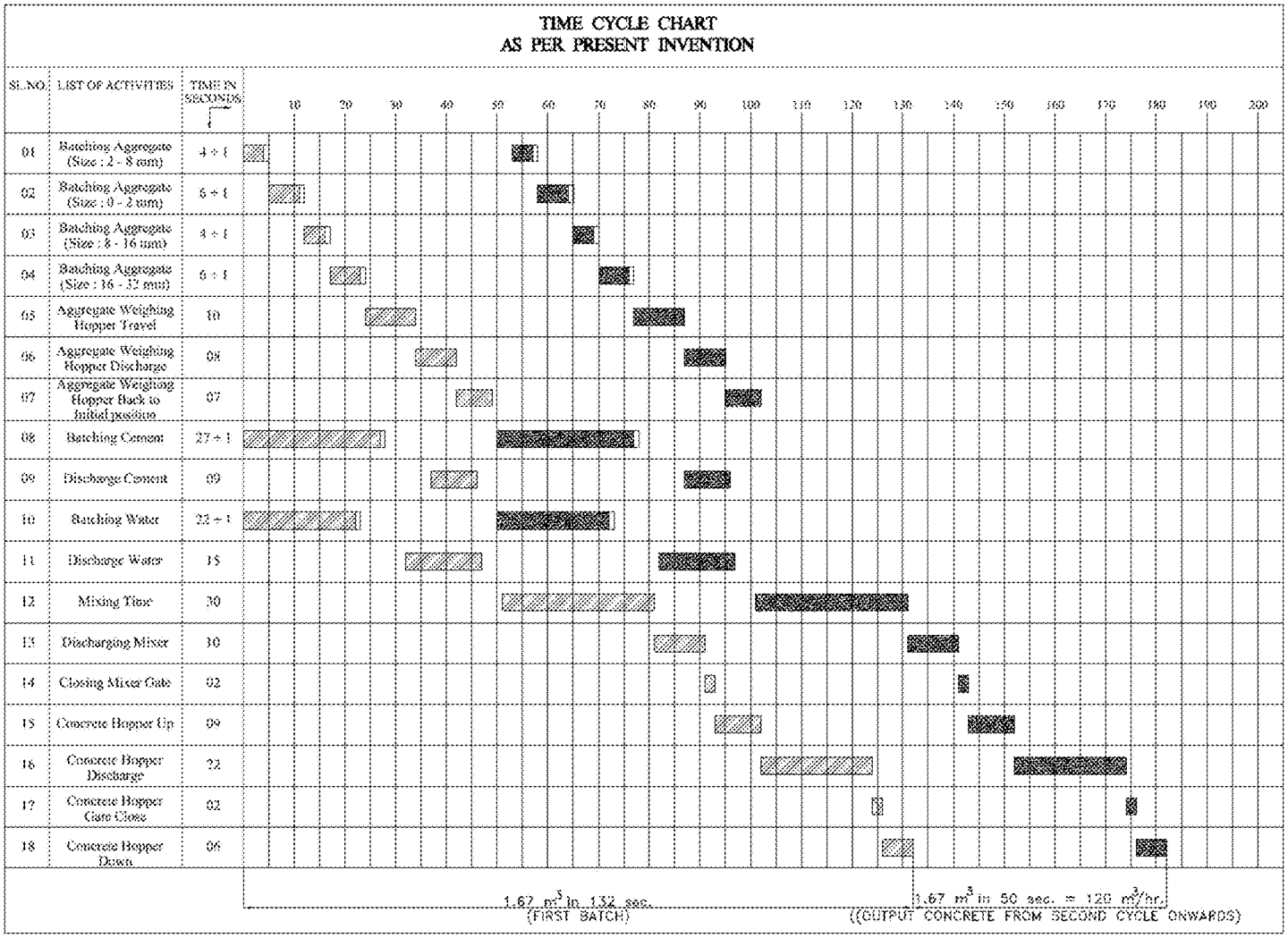
FIG. 10 is a time cycle chart as per the present invention.

The cycle time of the plant is optimized to have higher capacity of the plant in Cubic Metre/hour by reducing the batch size of the mixer nearly 45%. How the achieved is described in Table II and Table III and FIGS. 9 and 10 for a 120 $m^3$/hr capacity batching plant of concrete production.

The present invention is valid for various capacities from 20 $m^3$/hr up to 240 $m^3$/hr of concrete production.

TABLE I

INSTALLED POWER CALCULATION FOR 120 CM PER HOUR CAPACITY CONCRETE BATCHING PLANT

| | PRESENT DESIGN | | NEW DESIGN | |
|---|---|---|---|---|
| ACTIVITY | SKIP TYPE | CONVEYOR TYPE | With aggregate bins height 2.7 mtrs above the ground. Aggregate loading by loader from ground height. Weighed aggregates moved to mixer Hydraulically | With aggregate bins height 3.9 mtrs above the ground. Aggregate loading by super loader from ground height. Weighed aggregates moved to mixer Hydraulically |
| Aggregate bin feeding conveyor | 20 KW | 20 KW | — | — |
| Aggregate weighing conveyor | — | 22.5 KW | — | — |
| Skip motor | 45 KW | — | — | — |
| Inclined conveyor for mixer loading | — | 55 KW | — | — |
| Aggregate hopper for mixer loading and concrete hopper carrying together hydraulically. | — | — | 28 KW | 28 KW |

TABLE I-continued

INSTALLED POWER CALCULATION FOR 120 CM PER HOUR CAPACITY CONCRETE BATCHING PLANT

| | PRESENT DESIGN | | NEW DESIGN | |
|---|---|---|---|---|
| ACTIVITY | SKIP TYPE | CONVEYOR TYPE | With aggregate bins height 2.7 mtrs above the ground. Aggregate loading by loader from ground height. Weighed aggregates moved to mixer Hydraulically | With aggregate bins height 3.9 mtrs above the ground. Aggregate loading by super loader from ground height. Weighed aggregates moved to mixer Hydraulically |
| Mixer motor | 110 KW | 110 KW | 60 KW | 60 KW |
| Cement dosing Screw conveyor | 18.5 × 2 = 37 KW | 18.5 × 2 = 37 KW | 7.5 × 2 = 15 KW | 7.5 × 2 = 15 KW |
| High Pressure water pump | 7.5 KW | 7.5 KW | 7.5 KW | 7.5 KW |
| Total | 219.5 KW | 252 KW | 110.5 KW | 110.5 KW |

Note:
Other smaller common power requirements not considered.

TABLE II

COMPARISON OF TIME CYCLE FOR EACH ACTIVITY:

| List of Activities | Conventional Batching Plant (time in sec.) | Present batching Plant (time in sec.) |
|---|---|---|
| Batching Aggregate (size: 2-8 mm) | 4 + 1 | 4 + 1 |
| Batching Aggregate (size: 0-2 mm) | 7 + 1 | 6 + 1 |
| Batching Aggregate (size: 8-16 mm) | 4 + 1 | 4 + 1 |
| Batching Aggregate (size: 16-32 mm) | 7 + 1 | 6 + 1 |
| Discharge of Weighing Belt | 27 | — |
| Aggregate weighing hopper travel | — | 10 |
| Conveyance to Intermediate hopper | 27 + 24 | — |
| Aggregate Weighing hopper discharge | — | 08 |
| Intermediate hopper discharge | 14 | — |
| Aggregate weighing hopper back to initial position | — | 07 |
| Batching cement | 54 + 1 | 27 + 1 |
| Discharge cement | 11 | 09 |
| Batching water | 33 + 1 | 22 + 1 |
| Discharge water | 17 | 15 |
| Mixing time | 30 | 30 |
| Discharging mixer | 38 | 10 |
| Closing mixer gate | 3 | 2 |
| Concrete Hopper up | — | 09 |
| Concrete hopper discharge | — | 22 |
| Concrete hopper gate close | — | 02 |
| Concrete hopper down | — | 06 |

TABLE III

COMPARISON OF TIME CYCLE FOR BATCH:

| Parameter | Conventional | Present invention |
|---|---|---|
| Batch Size | 3 $m^3$ | 1.67 $m^3$ |
| $1^{st}$ batch time | 147 Sec. | 132 Sec. |

TABLE III-continued

COMPARISON OF TIME CYCLE FOR BATCH:

| Parameter | Conventional | Present invention |
|---|---|---|
| $2^{nd}$ batch time onward | 90 Sec. +/− 6 Sec. | 50 Sec. (+/−8%~10%) |
| Batch through put/hr | 120 $m^3$/hr +/− 8~10 $m^3$/hr. | 120 $m^3$/hr (+/−8%~10%) |

The present invention has been described with reference to some drawings and a preferred embodiment purely for the sake of understanding and not by way of any limitation and the present invention includes all legitimate developments within the scope of what has been described herein before and claimed in the appended claims.

I claim:

1. A concrete batching plant with reduced cycle time, comprising:

an aggregate storage bin divided into compartments for receiving aggregates comprising sand and stones of different sizes;

a weighing hopper configured to receive the aggregates from the storage bin;

a base structure for discharging a required amount of the aggregates into the weighing hopper mounted on a load cell placed below the storage bin by gravity through batching gates, wherein the aggregate storage bin is configured to be set at a height close to ground level;

a wheel loader configured to load the aggregates directly into the storage bin;

a lifting arrangement configured to hydraulically lift the weighing hopper with an inclination of a predetermined angle;

a gate placed below the weighing hopper and configured to discharge the aggregates into a mixer;

horizontal cement silos for supplying cement to the mixer;

a screw conveyor with an inclination configured to provide a dose of the cement to the mixer;

a cement weigher configured to weigh the cement;

a water weigher for weighing water before supplying water to the mixer; and a concrete carrying hopper travelling on a rail hydraulically for discharging contents of the concrete carrying hopper into a transit vehicle.

2. The concrete batching plant as claimed in claim 1, wherein the batching gates are opened and closed by pneumatic cylinders and the weighing hopper is configured to weigh a predetermined amount of the aggregate, thereby eliminating need for a weighing conveyor irrespective of a size and type of the plant.

3. The concrete batching plant as claimed in claim 1, wherein the aggregate weighed by the weighing hopper is lifted pneumatically.

4. The concrete batching plant as claimed in claim 1, wherein the mixer is mounted substantial at the ground level on a column structure.

5. The concrete batching plant as claimed in claim 1, wherein the hydraulically controlled concrete carrying hopper is lifted on rail by at least one of a rope and pulley system to reach a desired height.

6. The concrete batching plant as claimed in claim 1, wherein the horizontal cement silos have a discharge height of between about 2.5 meters and about 3.5 meters and a charging height between of about 7 meters and about 8 meters.

7. The concrete batching plant as claimed in claim 1, wherein the cement weigher is mounted above the mixer with an inlet height between of about 2.5 meters and 4.5 meters.

8. The concrete batching plant as claimed in claim 1, wherein the water weigher is mounted above the mixer at a height of about 3.5 meters and is configured to discharge water into the mixer by at least one of gravity, a pump, and a pressure nozzle.

9. A concrete batching plant, comprising:

an aggregate storage bin including a plurality of compartments configured to receive a material comprising sand and stones of different sizes at ground level from a wheel loader;

a plurality of batching gates filled at a bottom of the storage bin, and configured to discharge the material from the storage bin;

a weighing hopper configured to receive the material from the storage bin and weigh the material;

a first lifting arrangement configured to hydraulically lift the weighing hopper from a height of between about 2 meters and about 3 meters, to a height of between about 3 meters and about 3.5 meters above ground level;

a screw conveyer configured to convey cement;

a cement weigher configured to receive the cement via the screw conveyer;

a mixer configured to receive the cement from the cement weigher;

a water supplying apparatus configured to discharge water into the mixer via at least one of gravity, a pump, and a pressure nozzle, wherein the mixer is configured to mix and compact the material, the water and chemicals for a predetermined time to create a mixed and compacted concrete;

a concrete carrying hopper configured to receive the mixed and compacted concrete from the mixer;

a second lifting arrangement configured to lift the concrete carrying hopper with the mixed and compacted concrete to a desired height, wherein the second lifting arrangement includes at least one of a hydraulic lift, a rail, a rack-and-pinion, and a rope; and at least one of a mobile transit mixer and a concrete pump configured to receive the mixed and compacted concrete from the concrete carrying hopper.

* * * * *